US007812792B2

(12) United States Patent
Lee

(10) Patent No.: US 7,812,792 B2
(45) Date of Patent: Oct. 12, 2010

(54) ELECTRON EMISSION DISPLAY DEVICE AND CONTROL METHOD OF THE SAME

(75) Inventor: Ji Won Lee, Yongin (KR)

(73) Assignee: Samsung SDI Co., Ltd., Yongin-si (KR)

( * ) Notice: Subject to any disclaimer, the term of this patent is extended or adjusted under 35 U.S.C. 154(b) by 1078 days.

(21) Appl. No.: 11/499,431

(22) Filed: Aug. 4, 2006

(65) Prior Publication Data

US 2007/0030215 A1 Feb. 8, 2007

(30) Foreign Application Priority Data

Aug. 8, 2005 (KR) ..... 10-2005-0072506

(51) Int. Cl.
*G09G 3/20* (2006.01)

(52) U.S. Cl. ..... 345/75.2

(58) Field of Classification Search ..... 345/74.1, 345/75.2, 77

See application file for complete search history.

(56) References Cited

U.S. PATENT DOCUMENTS

| | | | | |
|---|---|---|---|---|
| 5,708,451 | A * | 1/1998 | Baldi | 345/75.2 |
| 6,489,938 | B1 * | 12/2002 | Ito | 345/63 |
| 2003/0122759 | A1 * | 7/2003 | Abe et al. | 345/89 |
| 2004/0183921 | A1 * | 9/2004 | Ueda | 348/222.1 |
| 2005/0001792 | A1 * | 1/2005 | Watanabe et al. | 345/55 |
| 2006/0087247 | A1 * | 4/2006 | Malmberg | 315/169.2 |

FOREIGN PATENT DOCUMENTS

| | | |
|---|---|---|
| JP | 2004-128653 | 4/2004 |
| KR | 2003-0049706 | 6/2003 |
| KR | 10-2005-0005762 | 1/2005 |

OTHER PUBLICATIONS

Korean Patent Abstracts, Publication 1020030049706 A, Published Jun. 25, 2003, in the name of Jang.
Korean Patent Abstracts, Publication 1020050005762 A, Published Jan. 14, 2005, in the name of Matsumoto.
Patent Abstracts of Japan, Publication 2004-128653, Published Apr. 22, 2004, in the name of Nishino, et al.

* cited by examiner

*Primary Examiner*—Chanh Nguyen
*Assistant Examiner*—Jonathan Blancha
(74) *Attorney, Agent, or Firm*—Christie, Parker & Hale, LLP

(57) ABSTRACT

An electron emission display device and a control method of the same. The electron emission display device includes a display region having a plurality of scanning lines and a plurality of data lines; a plurality of pixels arranged in regions defined by the scanning lines and the data lines; a data driving unit for transmitting a data signal to the data lines; a scanning driving unit for transmitting a scanning signal to the scanning lines; and a controlling unit for identifying display data for indicating a brightness displayed by the pixels, and correcting the input data input into the pixels using compensation coefficients corresponding to the pixels. In this electron emission device, the input data is corrected in the controlling unit by multiplying the compensation coefficients by the input data.

13 Claims, 6 Drawing Sheets

FIG. 1 --Related Art--
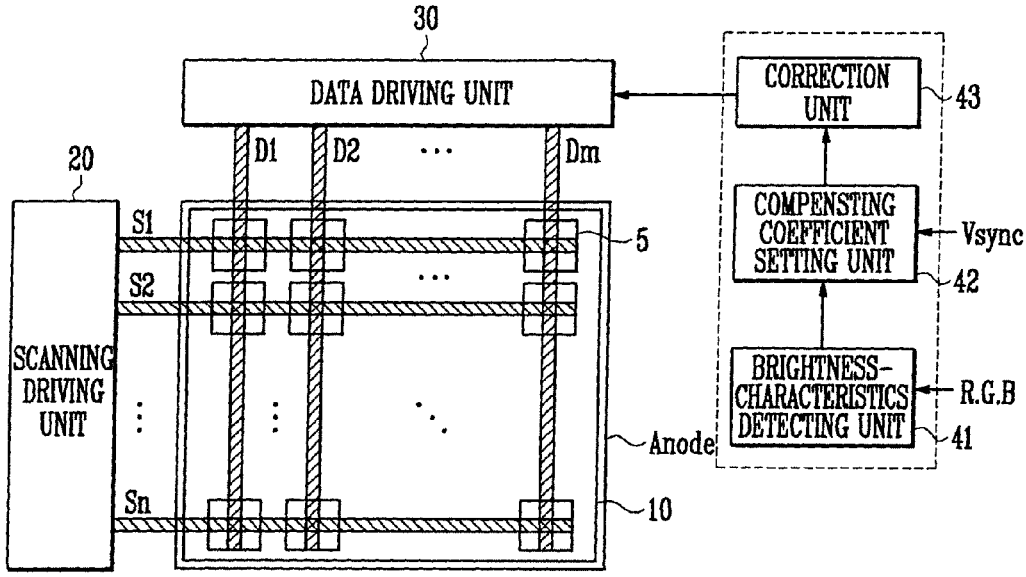
FIG. 2 --Related Art--
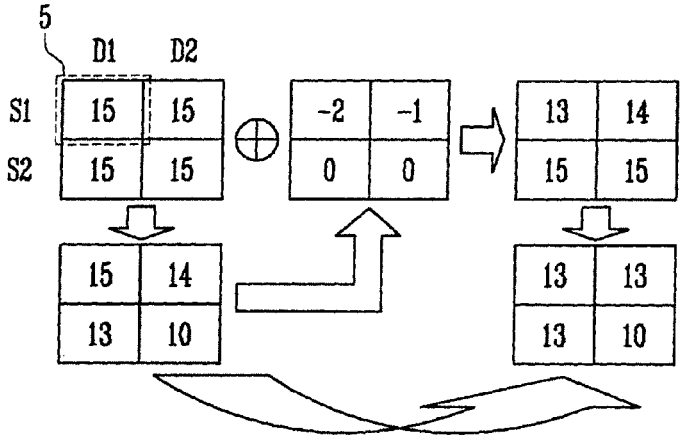

FIG. 3 --Related Art--
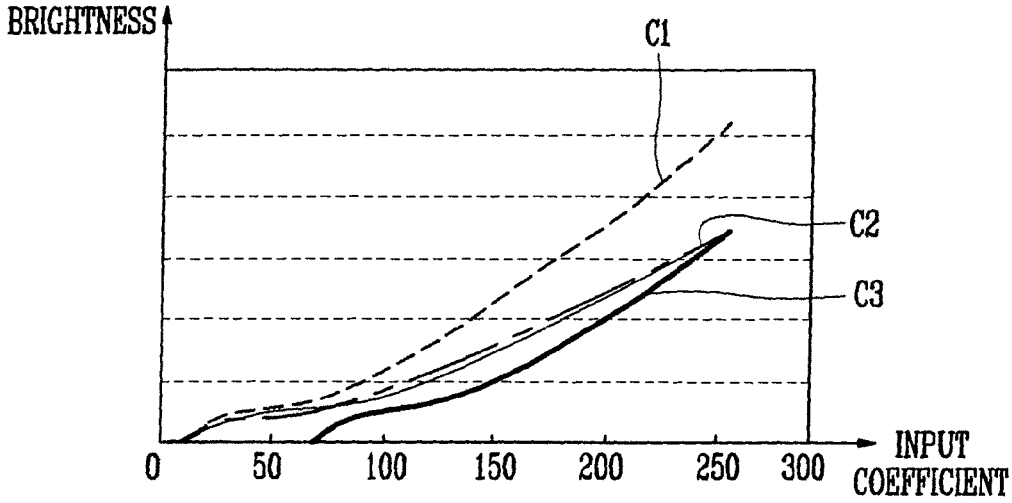
FIG. 4
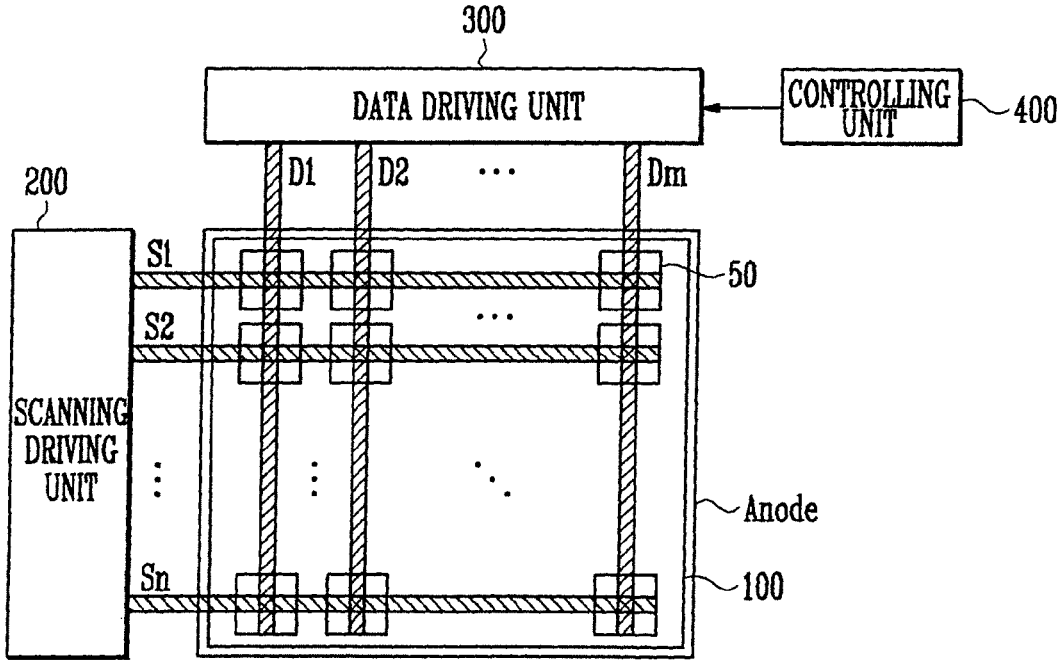

ELECTRON EMISSION DISPLAY DEVICE AND CONTROL METHOD OF THE SAME

CROSS-REFERENCE TO RELATED APPLICATION

This application claims priority to and the benefit of Korean Patent Application No. 10-2005-0072506, filed on Aug. 8, 2005, in the Korean Intellectual Property Office, the entire content of which is incorporated herein by reference.

BACKGROUND

1. Field of the Invention

The present invention relates to an electron emission display device and a control method of the same, and in particular, to an electron emission display device for controlling brightness characteristics in pixels so as to improve uneven light emission between the pixels, and a control method of the same.

2. Discussion of Related Art

An electron emission display device is a flat panel display device that is composed of a cathode, an anode and a gate electrode. More particularly, the cathode usually used as a scanning electrode is formed on a substrate. An insulating layer including an aperture (or a hole) and the gate electrode usually used as a data electrode are laminated on the cathode. In addition, an electron emitter is formed at the interior of the hole of the insulating layer so that it can be connected to the cathode.

The electron emission display device configured thus displays images by centering high electric fields on the emitter to emit electrons using a quantum-mechanical tunnel effect, accelerating the emitted electrons from the emitter using voltage applied between the cathode and the anode to collide with an RGB fluorescent layer formed on the anode, and causing the phosphors of the RGB fluorescent layer to emit light. Brightness of the images, which are displayed by colliding the emitted electrons with the RGB fluorescent layer to cause the phosphors to emit the light, is varied depending on values of the input video data.

FIG. 1 is a diagram showing one example of a configuration of a conventional electron emission display device.

Referring to FIG. 1, the conventional electron emission display device includes a display region 10, a scanning driving unit 20, a data driving unit 30, and a controlling unit 40.

The display region 10 includes a plurality of scanning lines (S1,S2, . . . ,Sn), a plurality of data lines (D1,D2, . . . Dm), and an anode. A plurality of pixels 5 are formed in regions defined by the scanning lines (S1,S2, . . . Sn) and the data lines (D1,D2, . . . Dm) crossing (or intersecting) the scanning lines (S1,S2, . . . Sn). The anode may be formed over the entire display region 10, as shown in FIG. 1. Also, the scanning lines (S1,S2, . . . Sn) are connected with the cathode, and the data lines (D1,D2, . . . Dm) are connected with the gate electrode. Alternatively, the data lines (D1,D2, . . . Dm) are connected with the cathode, and the scanning lines (S1,S2, . . . Sn) are connected with the gate electrode The scanning driving unit 20 subsequently applies scanning signals to the plurality of scanning lines (S1,S2, . . . Sn).

The data driving unit 30 applies data signals to the plurality of data lines (D1,D2, . . . Dm).

The controlling unit 40 includes a brightness-characteristic detecting unit 41, a compensation coefficient setting unit 42, and a correction unit 43. The brightness-characteristic detecting unit 41 detects brightness characteristics of images displayed by each of the pixels receiving the data signals. The compensation coefficient setting unit 42 stores information detected from the brightness-characteristic detecting unit 41. In addition, the compensation coefficient setting unit 42 resets and stores compensation coefficients by selecting at least one of the pixels 5, and controlling brightness characteristics of the other pixels 5 on the basis of the brightness characteristics of the images displayed by the selected pixel 5. The correction unit 43 compensates the brightness by adding input data corresponding to the brightness desired for the pixels 5 other than the selected pixel to the compensation coefficients stored in the compensation coefficient setting unit 42.

FIG. 2 is a diagram illustrating an addition compensation of the controlling unit 40 employed in the conventional electron emission display device of FIG. 1.

Referring to FIG. 2, the same input data are, for example, applied to each of the pixels 5 of the display region 10 which is shown for simplification purposes to have four pixels 5 so that each of the pixels 5 can display images of the same gray levels. In addition, FIG. 2 shows data lines D1 and D2 and scanning lines S1 and S2. As shown in FIG. 2, maximum brightness level is set to '15', and the input data corresponding to the brightness level of '15' are applied to each of the pixels 5 so that all four pixels 5 can be light-emitted with the brightness level of '15'. However, the actual light-emitted brightness may not be at the brightness level of '15', and its difference may be varied depending on each of the pixels 5. The addition compensation process was used in the prior art so as to prevent such uneven brightness of the separate pixels. The addition compensation compensates a brightness level of one or more of the pixels 5 by adding and subtracting the input data applied to each of the pixels. For example, when the input data corresponding to the maximum brightness level '15' is applied to each of the pixels 5, the four pixels 5 actually display the images having brightness levels of '15', '14', '13' and '10', respectively. Accordingly, since the maximum brightness level is '15', no brightness level may be improved more if brightness levels of the other pixels 5 are controlled on the basis of the pixel 5 displaying the brightness of '15'. Therefore, when the input data corresponding to '15' is applied, brightness of the other pixels 5 is controlled on the basis of the pixel 5 displaying the brightness level of '13'. That is, the brightness is controlled by subtracting the input data of '2' from the pixel 5 displaying the brightness of '15', and subtracting the input data of '1' from the pixel 5 displaying the brightness of '14', but the pixel 5 displaying the brightness of '13' is not controlled since the pixel 5 displaying the brightness of '13' is used as a reference pixel. Also, the brightness may still not be properly controlled (or maintained) because no input data signal is added to the pixel 5 displaying the brightness of '10'. After such, an addition driving process needs to be applied to compensate for the uneven brightness level of the images corresponding to most brightness levels of '13'.

FIG. 3 is a graph showing brightness characteristics controlled according to a conventional addition compensation process.

Referring to FIG. 3, a brightness curve C1 represents when the addition compensation process is not applied, that is, a brightness curve prior to the compensation; a reference brightness curve C2 represents brightness curves to be compensated; and a brightness curve C3 represents when the addition compensation process is applied, that is, a brightness curve after (or posterior to) the compensation.

As shown in FIG. 3, if an addition compensation process is used as the brightness-curve compensation process of the display region, the brightness level may still not be uniformly compensated even though the compensation coefficients are added and subtracted in brightness sublevels because the compensation coefficients are calculated on the basis of the maximum brightness level.

SUMMARY OF THE INVENTION

Accordingly, an aspect of the present invention provides an electron emission display device capable of providing more even (or uniform or exact) compensation of the pixels, and a control method of the same.

A first embodiment of the present invention provides an electron emission display device including a display region having a plurality of scanning lines and a plurality of data lines; a plurality of pixels arranged in regions defined by the scanning lines and the data lines; a data driving unit for transmitting a data signal to the data lines; a scanning driving unit for transmitting a scanning signal to the scanning lines; and a controlling unit for identifying display data for indicating a brightness displayed by the pixels, and for correcting the input data input into the pixels using compensation coefficients corresponding to the pixels. In the first embodiment, the input data is corrected in the controlling unit by multiplying the compensation coefficients by the input data.

A second embodiment of the present invention provides an electron emission display device including a display region having a plurality of scanning lines and a plurality of data lines; a plurality of pixels arranged in regions defined by the scanning lines and the data lines; a data driving unit for transmitting a data signal to the data lines; a scanning driving unit for transmitting a scanning signal to the scanning lines; and a controlling unit for identifying multidimensional curves corresponding to brightness characteristics of the pixels, and for correcting the multidimensional curves depending on compensation coefficients corresponding to the pixels.

A third embodiment of the present invention provides a method for controlling an electron emission display device. The method includes selecting at least two of a plurality of pixels to detect display data of the selected pixels; setting the display data of at least one of the selected pixels as reference display data, and setting compensation coefficients so that the input data of the pixels other than the at least one of the selected pixels can be corrected based on the reference display data; and correcting the input data by multiplying the compensation coefficients by the input data.

A fourth embodiment of the present invention provides a method for controlling an electron emission display device. The method includes selecting at least two of a plurality of pixels to detect brightness characteristics of the selected pixels; setting at least one of a plurality of multidimensional curves corresponding to the brightness characteristics of at least one of the selected pixels as a reference multidimensional curve; setting compensation coefficients so that the multidimensional curves of the pixels other than the at least one of the selected pixels can be corrected to approach the at least one of the multidimensional curves set as the reference multidimensional curve; and correcting the multidimensional curves of the pixels other than the at least one of the selected pixels using the compensation coefficients.

BRIEF DESCRIPTION OF THE DRAWINGS

The accompanying drawings, together with the specification, illustrate exemplary embodiments of the present invention, and, together with the description, serve to explain the principles of the present invention.

FIG. 1 is a diagram showing a configuration of a conventional electron emission display device.

FIG. 2 is a diagram illustrating an addition compensation of a controlling unit employed in conventional electron emission display device of FIG. 1.

FIG. 3 is a graph showing brightness characteristics controlled according to a conventional addition compensation process.

FIG. 4 is a diagram showing one embodiment of an electron emission display device according to the present invention.

DETAILED DESCRIPTION

Figure 5:
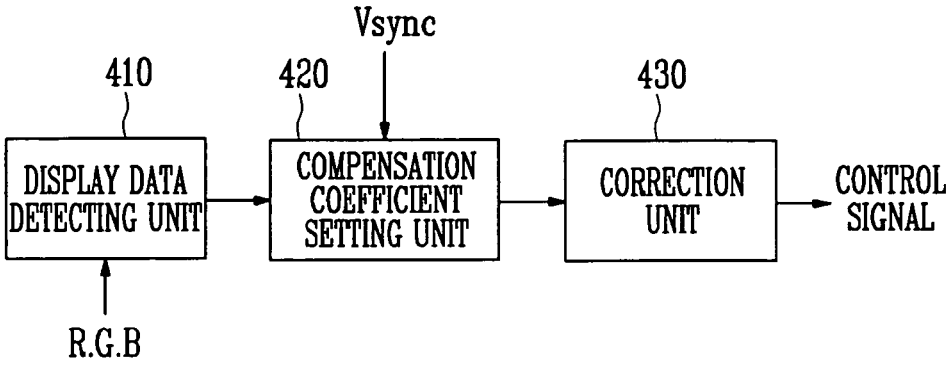
FIG. 5 is a diagram showing one embodiment of a controlling unit employed in the electron emission display device of FIG. 4.

In the following detailed description, certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

FIG. 4 is a diagram showing one embodiment of an electron emission display device according to the present invention.

Referring to FIG. 4, the electron emission display device according to the present invention includes a display region 100, a scanning driving unit 200, a data driving unit 300, and a controlling unit 400.

The display region 100 includes a plurality of scanning lines (S1, S2, . . . Sn), a plurality of data lines (D1, D2, . . . Dm), and an anode. In addition, a plurality of pixels 50 are formed in regions defined by the scanning lines (S1, S2, . . . Sn) and the data lines (D1, D2, . . . Dm). The anode may be formed over the display region 100, as shown in FIG. 4. Also, the scanning lines (S1,S2, . . . Sn) are connected with a cathode (not shown), and the data lines (D1,D2, . . . Dm) are connected with a gate electrode (not shown). Alternatively, the data lines (D1,D2, . . . Dm) are connected with the cathode electrode, and the scanning lines (S1,S2, . . . Sn) are connected with the gate electrode.

The scanning driving unit 200 subsequently applies scanning signals to the scanning lines (S1,S2, . . . Sn).

The data driving unit 300 applies data signals to the data lines (D1,D2, . . . Dm).

The controlling unit 400 identifies display data light-emitted by one or more of the pixels 50, and corrects data input into the one or more of the pixels 50 using compensation coefficients corresponding to the one or more pixels 50. Also, the controlling unit 400 identifies multi-dimensional curves corresponding to brightness characteristics of the one or more of the pixels 50, and corrects the multi-dimensional curves using the compensation coefficients corresponding to the one or more of the pixels 50. The controlling unit 400 will be described in more detail with reference to FIGS. 5 and 9.

FIG. 5 is a diagram showing one embodiment of a controlling unit (e.g., 400) employed in the electron emission display device of FIG. 4.

The controlling unit of FIG. 5 includes a display data detecting unit 410, a compensation coefficient setting unit 420, and a correction unit 430.

The display data detecting unit 410 receives input data corresponding to the brightness desired (or required) for one or more of the pixels 50, and then detects display data actually displayed by the one or more of the pixels 50. Here, the display data detecting unit 410 may select at least two of the pixels 50 to detect the display data of the selected pixels 50.

The compensation coefficient setting unit 420 receives the display data (and a synchronization signal Vsync), and sets (or resets) the display data of at least one of the selected pixels 50 from the display data detecting unit 410 as a reference data, and sets (or resets) compensation coefficients so that the input data of the pixels other than the reference pixel can be corrected.

The correction unit 430 compensates the brightness of the pixels 50 by multiplying the compensation coefficients set (or reset) in the compensation coefficient setting unit 420 by the input data of the pixels 50. Here, the correction unit 430 corrects the input data by multiplying the compensation coefficients by the input data of the pixels 50.

The input data is data input into one or more of the pixels 50 to correspond to brightness levels, which are displayed by the one or more of the pixels 50, and the display data is data corresponding to brightness levels, which are actually displayed by the one or more of the pixels 50.

Figure 6:
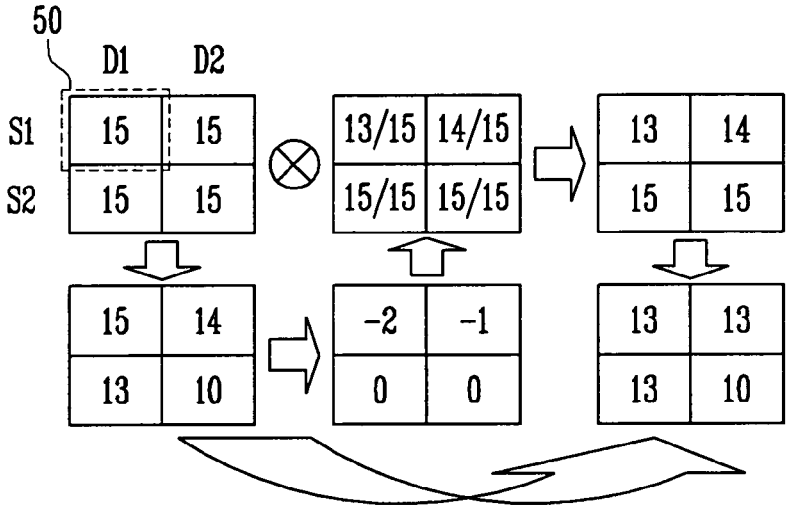
FIG. 6 is a diagram showing a brightness compensation process according to one embodiment of the present invention.

FIG. 6 is a diagram showing a brightness compensation process according to one embodiment of the present invention.

Referring to FIG. 6, the same input data are, for example, applied to pixels 50 of the display region 100 which is shown for simplification purposes to have four pixels 50 so that each of the pixels 50 can display images of the same gray levels. In addition, FIG. 6 shows data lines D1 and D2 and scanning lines S1 and S2. Here, when the data signal is applied to the pixels 50 so that all four of the pixels 50 are set to have brightness levels (or gray levels) of '15' (in which '15' corresponds to the maximum brightness level), the brightness levels of the images actually displayed by the four pixels 50 are '15', '14', '13' and '10', respectively. To compensate for these brightness level non-uniformities, the pixel 50 displaying the brightness level of '13' is used as a reference pixel to control brightness levels of the other pixels 50. That is, the compensation coefficients corresponding to each of the pixels 50 is set to be a brightness level of '13' and controlled so that the pixels 50 can be light-emitted with uniform brightness by multiplying the compensation coefficients by the input data of each of the pixels 50.

Figure 7:
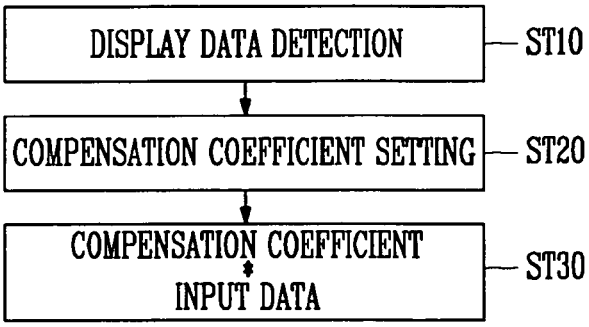
FIG. 7 is a flow chart showing an operation according to one embodiment of the present invention.

FIG. 7 is a flow chart showing an operation according to one embodiment of the present invention.

Referring to FIG. 7, the electron emission display device according to one embodiment of the present invention is operated from a first step (ST10) to a third step (ST30).

The first step (ST10) selects at least two pixels from a plurality of pixels to detect display data of the selected pixels. Here, the first step (ST10) is detecting the brightness levels that the pixels receiving input data are actually displaying.

The second step (ST20) sets the display data of at least one of the selected pixels as a reference display data, and sets compensation coefficients so that the input data of the pixels other than the reference pixel can be corrected on the basis of the reference display data.

The third step (ST30) corrects the input data using the compensation coefficients. Here, the input data are corrected by multiplying the compensation coefficients by the input data.

Here, the input data is data input into one or more of the pixels to make the one or more of the pixels have certain desired brightness levels, and the display data is data corresponding to brightness levels which are actually displayed by the one or more of the pixels.

Figure 8:
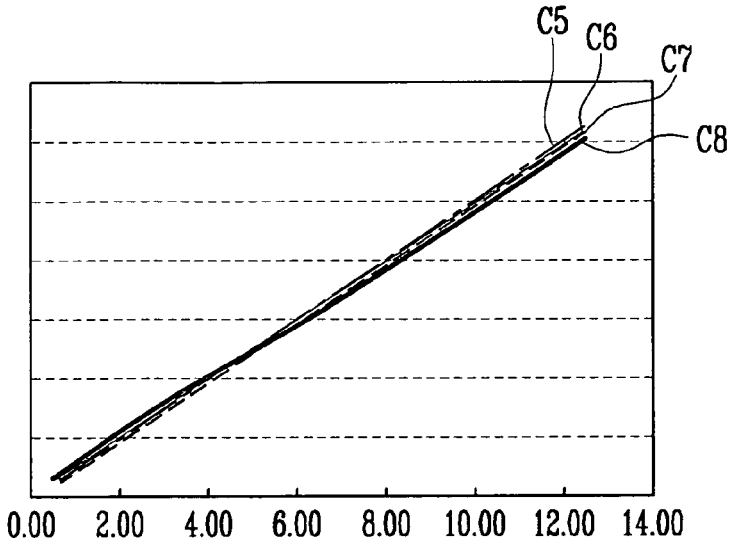
FIG. 8 is a graph showing brightness levels controlled according to one embodiment of the present invention.

FIG. 8 is a graph showing brightness levels controlled according to one embodiment of the present invention.

Referring to FIG. 8, curves C5 to C8 are for representing the brightness characteristics corresponding to each of the pixels 50 as shown in FIG. 6. In one embodiment of the present invention, the brightness is controlled by multiplying the compensation coefficients corresponding to each of the pixels 50 by the data input into the pixels 50. Accordingly, as described with reference to FIG. 6, although the compensation coefficients are applied to brightness sublevels, the compensation coefficients reset on the basis of the maximum brightness level may comply with a desired trend line because the compensation coefficients are set to different ratios depending on the brightness levels in a multiplication compensation manner.

Figure 9:
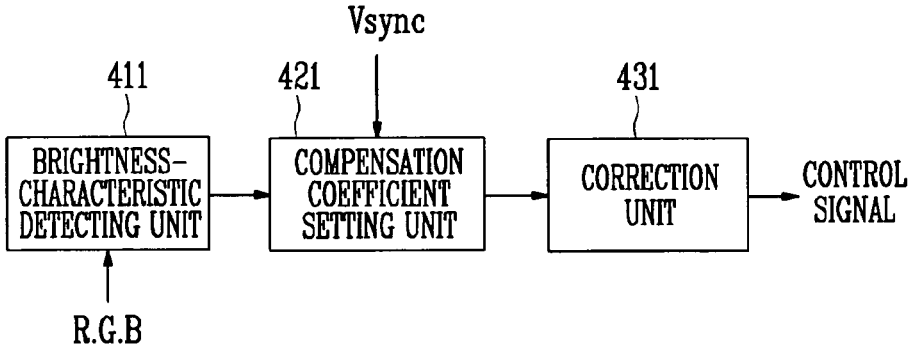
FIG. 9 is a diagram showing another embodiment of a controlling unit employed in the electron emission display device of FIG. 4.

FIG. 9 is a diagram showing another embodiment of a controlling unit (e.g., 400) employed in the electron emission display device of FIG. 4.

The controlling unit includes a brightness-characteristic detecting unit 411, a compensation coefficient setting unit 421, and a correction unit 431.

The brightness-characteristic detecting unit 411 detects the brightness characteristics of the images displayed by each of the pixels 50 to correspond to the input data signals. For example, the brightness-characteristic detecting unit 411 selects at least two of the pixels 50, and detects and stores the brightness levels (corresponding to all values of the 0 to 255 gray levels) of the selected pixels 50. Also, the brightness characteristics of the other pixels 50 may be derived (or anticipated) depending on the brightness characteristics of the selected pixels 50, and the brightness characteristics of the pixels are presented in a multi-dimensional manner (or by a multi-dimensional equation).

The compensation coefficient setting unit 421 receives the detected brightness characteristics from the brightness-characteristic detecting unit 411 (and a synchronization signal Vsync), and sets (or resets) a multi-dimensional curve displaying the brightness characteristics of at least one of the pixels 50 as a reference multi-dimensional curve. Here, multi-dimensional curves displaying the brightness characteristics of the pixels 50 other than the reference pixel 50 are curves that previously reset and store compensation coefficients, and are to be compensated so as to approach the reference multi-dimensional curve. Also, the compensation coefficient setting unit 421 generates a table regarding the brightness characteristics and the compensation coefficients of one or more of the pixels 50. Here, the compensation coefficients are values which compensate coefficients of the multi-dimensional equation corresponding to the multi-dimensional curves of the pixels 50 depending on a brightness-characteristic curve reset as the reference multi-dimensional curve.

The correction unit 431 multiplies the compensation coefficients by the coefficients of the multi-dimensional equation corresponding to the brightness-characteristic curves of the pixels 50 and then outputs control signals corresponding to the resultant values. Also, the other curves may be controlled depending on the reference trend line by setting compensation coefficients to different values for each of the gray levels.

Figure 10:
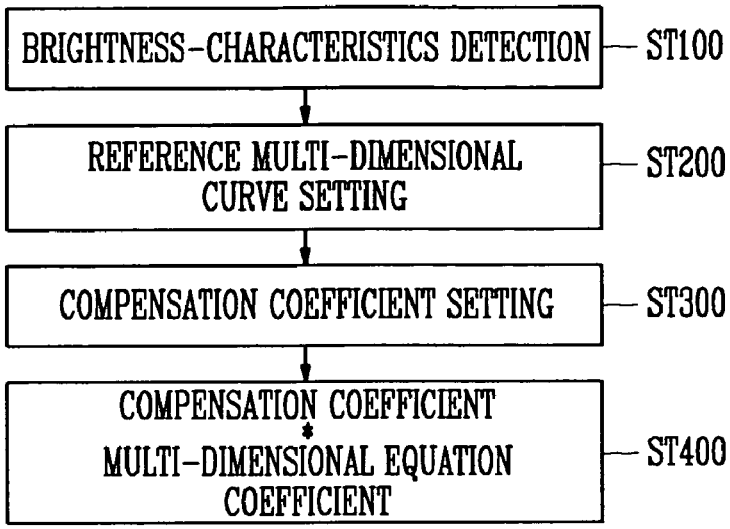
FIG. 10 is a flow chart showing an operation according to the another embodiment of the present invention.

FIG. 10 is a flow chart showing an operation according to another embodiment of the present invention.

Referring to FIG. 10, the electron emission display device according to another embodiment of the present invention is operated from a first step (ST100) to a fourth step (ST400).

The first step (ST100) selects at least two pixels from a plurality of pixels to detect brightness levels corresponding to gray levels of the selected pixels. That is, the brightness data received by one or more of the pixels, and the brightness characteristics actually light-emitted by the one or more of the pixels, are detected in the first step (ST100).

The second step (ST200) sets a multi-dimensional curve corresponding to a brightness characteristic of at least one of the selected pixels.

The third step (ST300) sets compensation coefficients so that a multi-dimensional equation corresponding to the brightness-characteristic curves of one or more of the pixels other than the reference pixel can be corrected to approach the curves presented by the multi-dimensional equation and reset as the reference multi-dimensional curve in the second step (ST200). Here, the compensation coefficients are values which compensate coefficients of the multi-dimensional equation corresponding to the brightness-characteristic curves of the one or more pixels depending on the brightness-characteristic curves reset as the reference multi-dimensional curve.

The fourth step (ST400) controls the brightness of the display region by correcting the multi-dimensional equation corresponding to the brightness-characteristic curves of the one or more pixels depending on the compensation coefficients reset in the third step (ST300). Here, the multi-dimensional equation is corrected by multiplying the compensation coefficients by the coefficients of the multi-dimensional equation corresponding to each of the pixels.

Figure 11A:
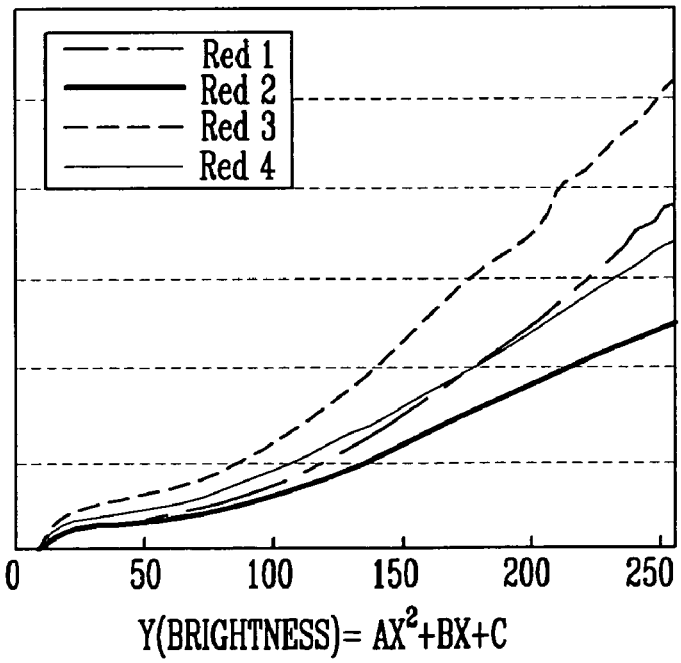
FIGS. 11A and 11B are graphs showing brightness levels according to the conventional electron emission display device and the another embodiment of the present invention as shown in FIG. 9, respectively.
Figure 11B:
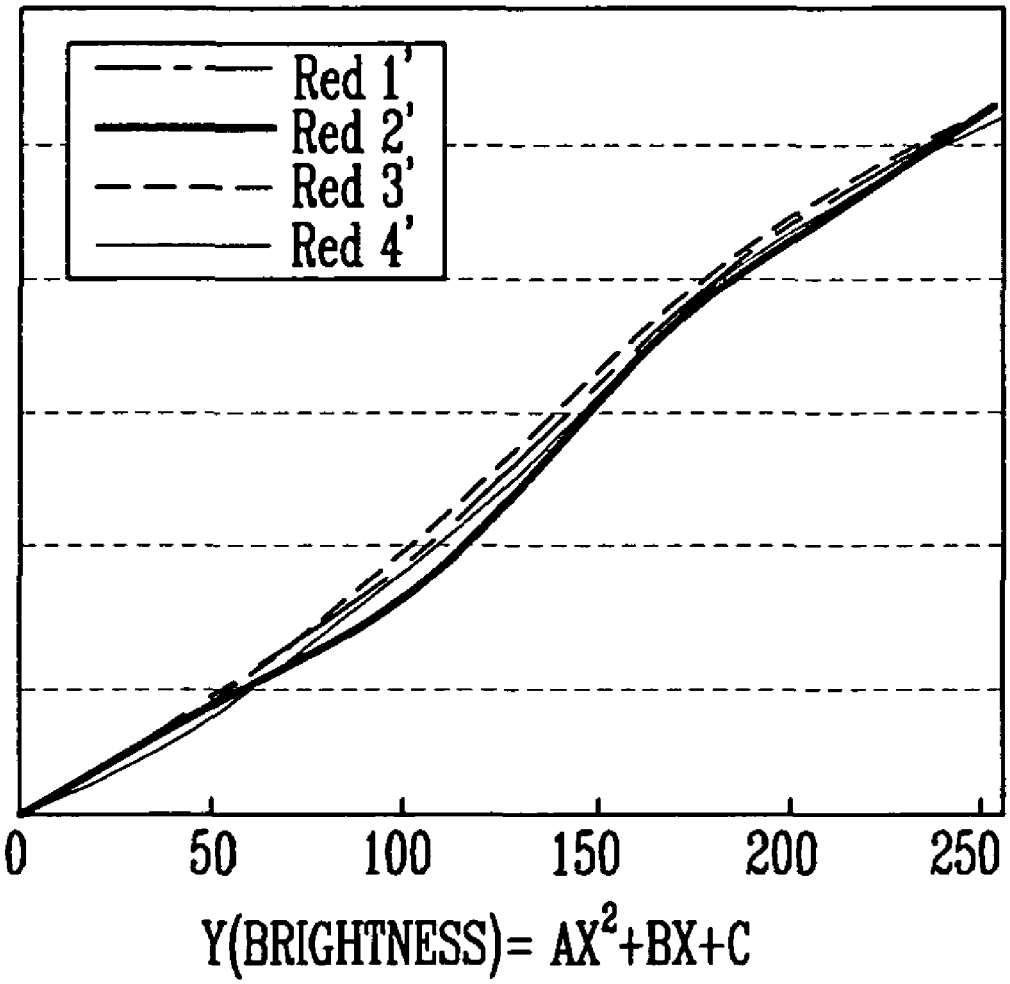

FIG. 11A is a graph showing brightness levels according to the conventional electron emission display devices, and FIG. 11B is a graph showing brightness levels according to the another embodiment of the present invention as shown in FIG. 9.

Referring to FIGS. 11A and 11B, in the graph showing the input brightness data of the pixels by the conventional electron emission display device to the actually light-emitted brightness levels, it can be seen that all the brightness levels of the actually light-emitted pixels may vary when they are given the same gray level. By contrast, referring to the brightness levels of the pixels corrected according to the another embodiment of the present invention, all the brightness-characteristic curves of the pixels appear to be similar (or substantially the same) with each other because the brightness characteristics of the pixels other than the reference pixel are controlled to depend on the brightness-characteristic curves of the images displayed by the reference pixel. For example, assuming that a brightness-characteristic curve of RED4' is set (or reset) as a reference curve, then a brightness-characteristic curve of RED1' is controlled as follows.

Assuming that an equation corresponding to a brightness-characteristic curve of RED4' is represented by $AX^2+BX+C=Y$ (brightness), and an equation corresponding to a brightness-characteristic curve of RED1' is represented by $DX^2+EX+F=Y$ (brightness), the brightness-characteristic curve of RED1' is compensated by the coefficients to approach the brightness-characteristic curve of RED4'. That is, the coefficient is compensated so that $DX^2$ multiplied by the compensation coefficients of A/D makes $AX^2$, and EX multiplied by the compensation coefficients of B/E makes BX. Also, the coefficient is compensated so that F multiplied by the compensation coefficients of C/F makes C. In addition, the above described compensation process may be applied to brightness-characteristic curves of RED2' and RED3' to control the brightness-characteristic curves of RED2' and RED3'. As such, the applied compensation coefficients are varied in the pixels and the gray levels.

Here, according to the graph shown in FIG. 8, although the curves C5, C6, C7, and C8 displaying the brightness characteristics appear to comply with a linear equation, they actually comply with the multi-dimensional equation (or the non-linear multidimensional equation), as shown in FIG. 11B. Accordingly, one embodiment of the present invention compensates the brightness by multiplying the compensation coefficients by the coefficients of the multi-dimensional equation.

In view of the above, an electron emission display device and a control method of the same according to certain embodiments of the present invention compensate uneven light emission between the pixels of the electron emission display device to the have more uniform (or exact) values.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission display device comprising:

a display region comprising a plurality of scanning lines and a plurality of data lines;

a plurality of pixels arranged in regions defined by the scanning lines and the data lines;

a data driving unit for transmitting a data signal to the data lines;

a scanning driving unit for transmitting a scanning signal to the scanning lines; and a controlling unit for identifying display data for indicating a brightness displayed by the pixels, for separately determining a compensation coefficient for each of the pixels, and for correcting input data input into each of the pixels;

wherein the input data for each of the pixels is corrected in the controlling unit by multiplying the compensation coefficient by the input data, wherein the controlling unit comprises:

a display data detecting unit for randomly selecting at least two and less than all of the pixels to detect the display data of the selected pixels;

a compensation coefficient setting unit for setting the display data of at least one of the selected pixels as reference display data, and setting compensation coefficients so that the input data of the pixels other than the at least one of the selected pixels can be corrected based on the reference display data; and a correction unit for correcting the input data by multiplying the compensation coefficients by the input data, and wherein the compensation coefficient of each of the pixels is in the form of a first constant value divided by a second constant value, the second constant value being greater than one or less than one.

2. The electron emission display device according to the claim 1, wherein the input data is data input into the pixels to provide the pixels with desired brightness levels, and the display data is data corresponding to brightness levels actually displayed by the pixels.

3. An electron emission display device comprising:

a display region comprising a plurality of scanning lines and a plurality of data lines;

a plurality of pixels arranged in regions defined by the scanning lines and the data lines;

a data driving unit for transmitting a data signal to the data lines;

a scanning driving unit for transmitting a scanning signal to the scanning lines; and a controlling unit for identifying multidimensional curves corresponding to brightness characteristics of the pixels, for separately determining compensation coefficients for each of the pixels, and for correcting the multidimensional curves depending on the compensation coefficients corresponding to the pixels, wherein the controlling unit comprises:

a brightness-characteristic detecting unit for selecting at least two and less than all of the pixels to detect brightness characteristics of the selected pixels;

a compensation coefficient setting unit for setting at least one of the multidimensional curves corresponding to the brightness characteristics of at least one of the selected pixels as a reference multidimensional curve, and setting compensation coefficients so that the multidimensional curves of the pixels other than the at least one of the selected pixels can be corrected based on the reference multidimensional curve; and a correction unit for correcting the multidimensional curves of the other pixels using the compensation coefficients, and wherein each of the compensation coefficients is in the form of a first constant value divided by a second constant value, the second constant value being greater than one or less than one.

4. The electron emission display device according to the claim 3, wherein the correction unit corrects the multidimensional curves of the pixels other than the at least one of the selected pixels by multiplying the compensation coefficients by constants of multidimensional equations corresponding to the multidimensional curves of the pixels other than the at least one of the selected pixels.

5. The electron emission display device according to the claim 3, wherein each of the compensation coefficients has a first constant value corresponding to the reference multidimensional curve and a second constant value corresponding to at least one of the multidimensional curves of the pixels other than the at least one of the selected pixels.

6. The electron emission display device according to the claim 3, wherein the multidimensional curves are represented by non-linear equations.

7. The electron emission display device according to the claim 3, wherein the multidimensional curves are represented by multidimensional equations.

8. The electron emission display device according to the claim 3, wherein each of the compensation coefficients is in the form of a ratio.

9. A method for controlling an electron emission display device, the method comprising:

selecting at least two and less than all of a plurality of pixels to detect display data of the selected pixels;

setting the display data of at least one of the selected pixels as reference display data, and setting, separately, a compensation coefficient for each of the pixels other than the at least one of the selected pixels so that the input data of the pixels other than the at least one of the selected pixels can be corrected based on the reference display data; and correcting the input data for each of the pixels other than the at least one of the selected pixels by multiplying the compensation coefficient by the input data, wherein the compensation coefficient for each of the pixels is in the form of a first constant value divided by a second constant value, the second constant value being greater than one or less than one.

10. The method for controlling the electron emission display device according to the claim 9, wherein the selecting of the at least two of the plurality of pixels to detect the display data of the selected pixels comprises detecting brightness levels actually displayed by the pixels.

11. A method for controlling an electron emission display device, the method comprising:

selecting at least two and less than all of a plurality of pixels to detect brightness characteristics of the selected pixels;

setting at least one of a plurality of multidimensional curves corresponding to the brightness characteristics of at least one of the selected pixels as a reference multidimensional curve;

setting, separately, compensation coefficients for each of the multidimensional curves of the pixels other than the at least one of the selected pixels so that the multidimensional curves of the pixels other than the at least one of the selected pixels can be corrected to approach the at least one of the multidimensional curves set as the reference multidimensional curve; and correcting the multidimensional curves of the pixels other than the at least one of the selected pixels using the compensation coefficients, wherein each of the compensation coefficients is in the form of a first constant value divided by a second constant value, the second constant value being greater than one or less than one.

12. The method for controlling the electron emission display device according to the claim 11, wherein the selecting the at least two of the plurality of pixels to detect brightness characteristics of the selected pixels comprises detecting brightness data input into the pixels, and brightness characteristics actually light-emitted by the selected pixels.

13. The method for controlling the electron emission display device according to the claim 11, wherein the correcting the multidimensional curves of the pixels other than the at least one of the selected pixels using the compensation coefficients comprises correcting the multidimensional curves by multiplying the compensation coefficients by constants of multidimensional equations corresponding to the multidimensional curves.

* * * * *